US008162780B2

(12) United States Patent
Wang

(10) Patent No.: US 8,162,780 B2
(45) Date of Patent: Apr. 24, 2012

(54) TRAINING DEVICE FOR HITTING A BALL

(76) Inventor: Lian-Cheng Wang, Wuqi Township, Taichung County (TW)

( * ) Notice: Subject to any disclaimer, the term of this patent is extended or adjusted under 35 U.S.C. 154(b) by 0 days.

(21) Appl. No.: 12/693,378

(22) Filed: Jan. 25, 2010

(65) Prior Publication Data

US 2011/0183782 A1 Jul. 28, 2011

(51) Int. Cl.
*A63B 69/00* (2006.01)
*A63B 71/00* (2006.01)

(52) U.S. Cl. ..... 473/417; 473/422

(58) Field of Classification Search ..... 473/417, 473/422, 418–420, 386, 387, 715
See application file for complete search history.

(56) References Cited

U.S. PATENT DOCUMENTS 2,616,692 A * 11/1952 Bird ..... 473/417
5,772,536 A * 6/1998 Wang ..... 473/417
5,897,444 A * 4/1999 Hellyer ..... 473/417
D430,243 S * 8/2000 Alberti et al. ..... D21/715
6,884,185 B2 * 4/2005 Udwin et al. ..... 473/417
2010/0056306 A1 * 3/2010 Chen ..... 473/417
* cited by examiner

*Primary Examiner* — Mitra Aryanpour
(74) *Attorney, Agent, or Firm* — Jackson IPG PLLC; Demian K. Jackson

(57) ABSTRACT

A training device for hitting a ball includes a spiral pipe and a base. The spiral pipe is composed of a plurality of dual-awl ring members connected together to form an adjustable pipe. The spiral pipe includes a top pipe at an upper end thereof to connect with a socket, a bottom pipe and a positioning sleeve at a lower end thereof to connect with a through hole and a stepped hole of the base. The base is in the shape of a home plate. The base has the through hole at a central portion thereof and the stepped trough underneath the through hole. The base includes at least two plates having relative connecting surfaces which are formed with notches and protrusions to engage with each other. The protrusions are engaged with the notches for assembling the two plates to become one-piece. The bottom pipe is inserted in the through hole with the first stop ring to be blocked on the through hole. The positioning sleeve is inserted in the stepped trough with the second stop ring being secured in the stepped trough. The first stop ring and the second stop ring are secured in the middle of the base such that the spiral pipe is mounted on the base. The socket is fitted on the top pipe to complete the assembly of the present invention.

6 Claims, 10 Drawing Sheets

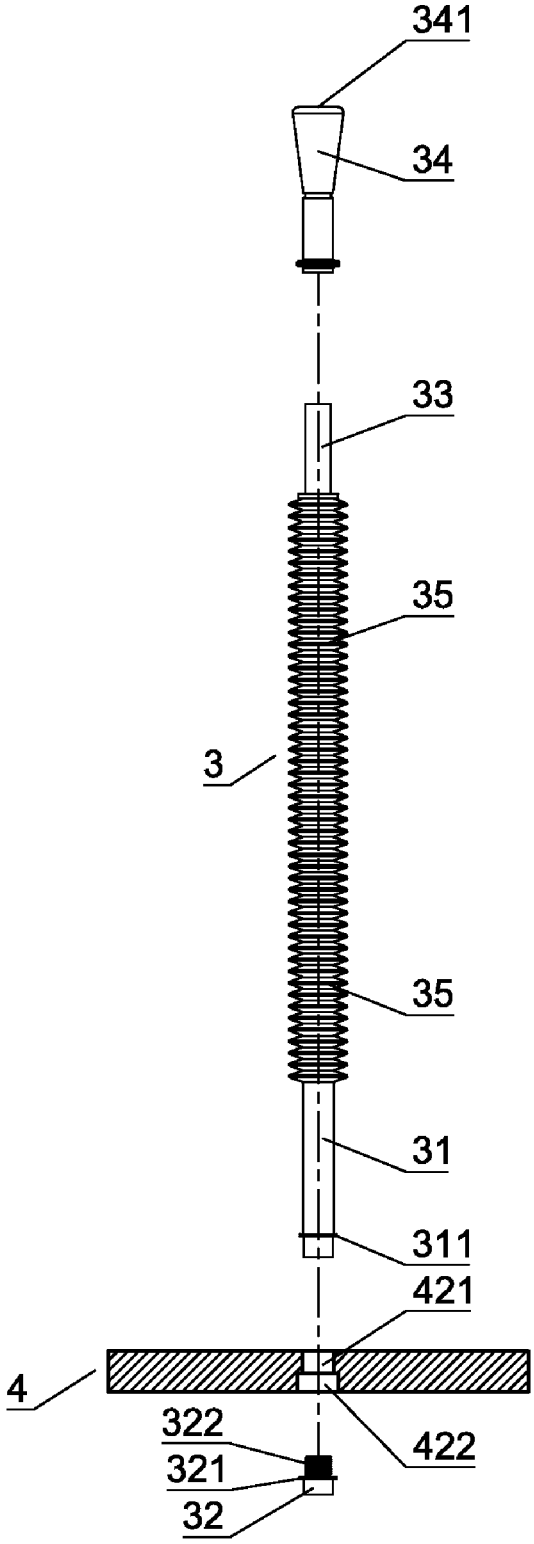
Fig. 1-A

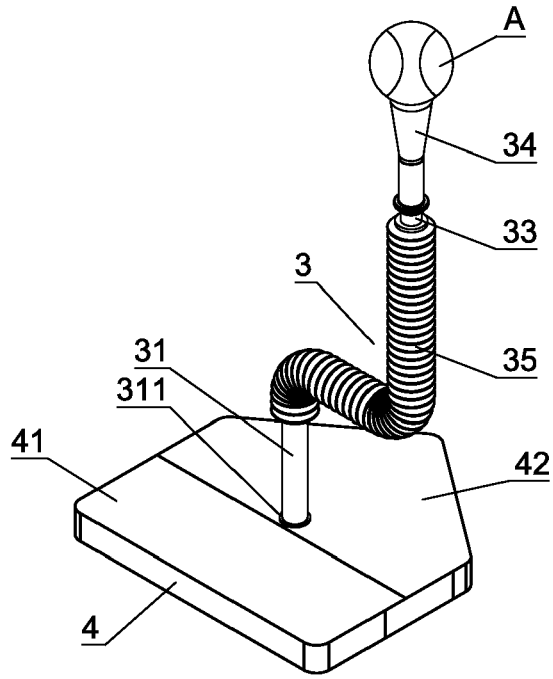
Fig. 3
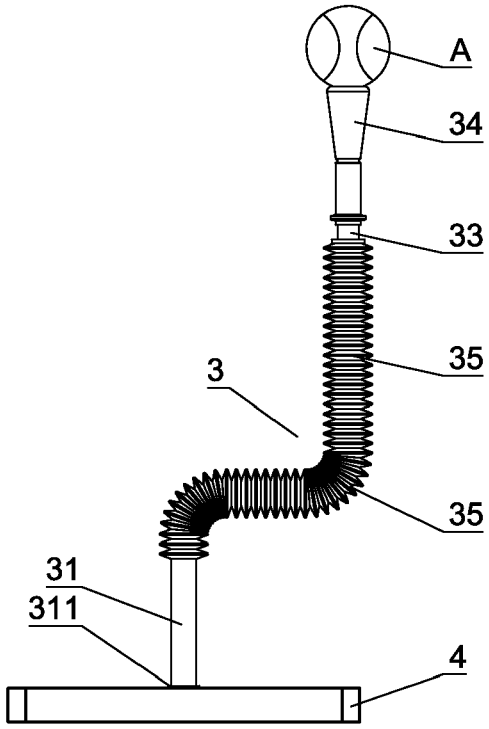
Fig. 3-A

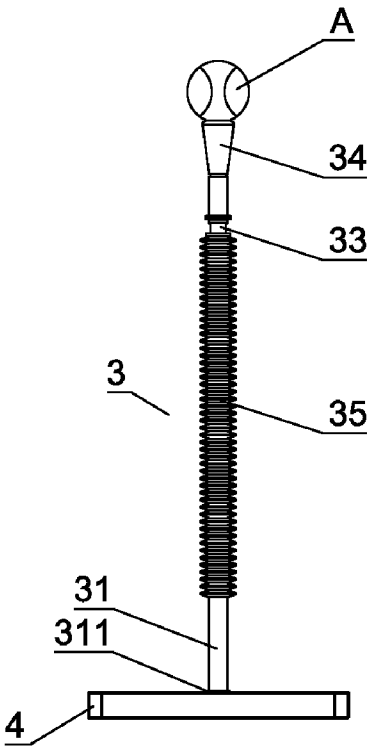
Fig. 7-A
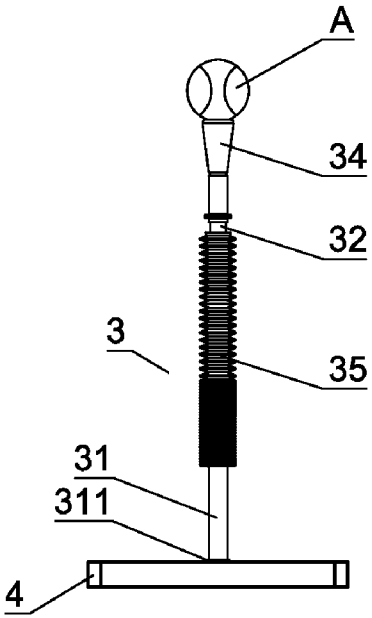
Fig. 6-A
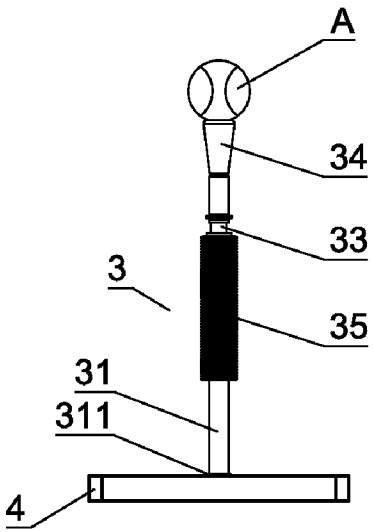
Fig. 5-A

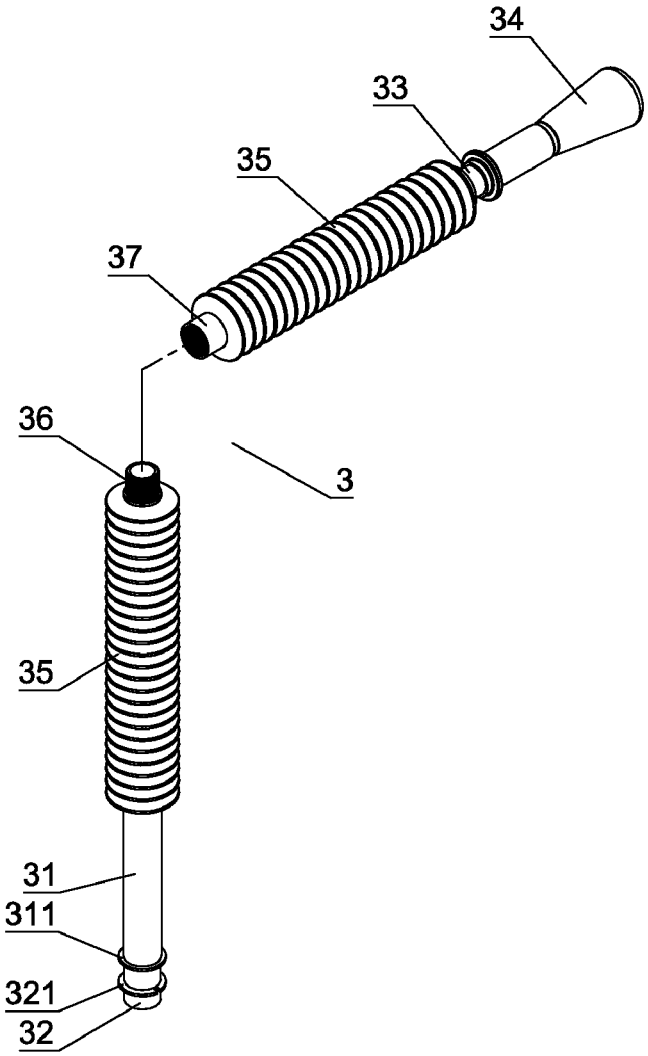
Fig. 8
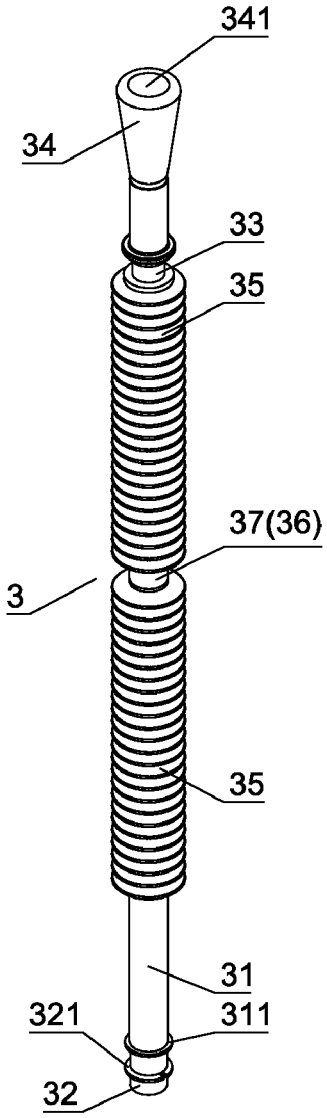
Fig. 8-A

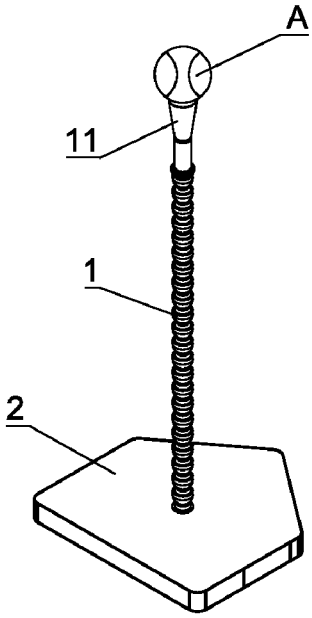
Fig. 10
-Prior Art-
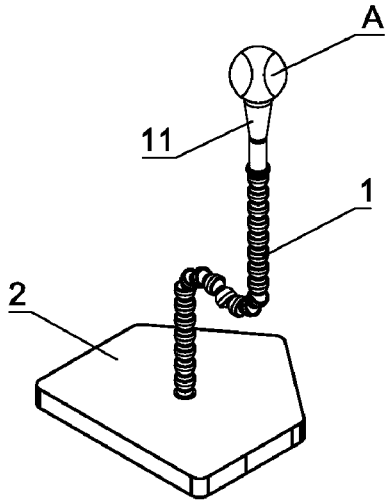
Fig. 11
-Prior Art-
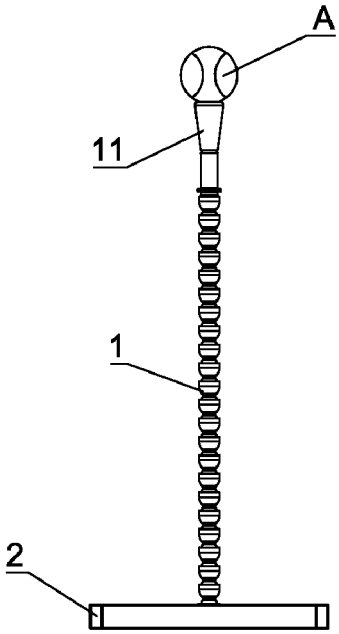
Fig. 10-A
-Prior Art-
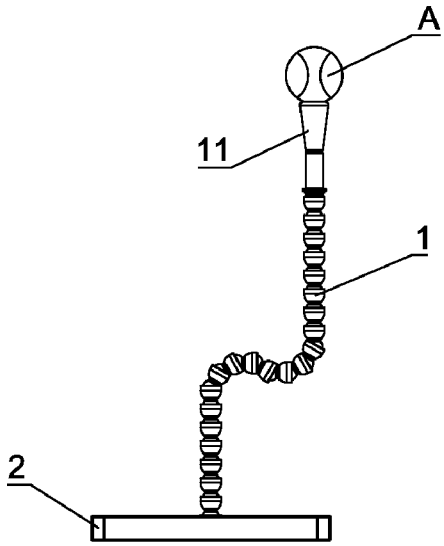
Fig. 11-A
-Prior Art- -Prior Art-

TRAINING DEVICE FOR HITTING A BALL

BACKGROUND OF THE INVENTION

1. Field of the Invention

The present invention relates to a training device, and more particularly to a training device for hitting a ball that is able to be at different angles and restore itself, providing the user to practice hitting. The training device is convenient for storage.

2. Description of the Prior Art

As shown in FIGS. 10 to 11A, a conventional training device for hitting a ball comprises a spiral pipe 1 and a base 2. The base 2 has a through hole at a central portion thereof and a stepped trough underneath the through hole. The through hole is adapted for insertion of a positioning sleeve. One end of the positioning sleeve is formed with an engaging edge, and another end of the positioning sleeve is formed with outer threads. The distal end of the spiral pipe 1 is formed with inner threads to engage with the outer threads of the positioning sleeve, such that the spiral pipe 1 is coupled with the positioning sleeve which protrudes from the base 2. The top of the spiral pipe 1 is connected with a socket 11. The socket 11 has a free end to form a recess for holding a hit article. The angle of the spiral pipe 1 with respect to the base 2 is adjustable, so that the hit article A can be at various angles and hit positions. However, the conventional training device is not convenient for assembly and storage. Accordingly, the inventor of the present invention has devoted himself based on his many years of practical experiences to solve this problem. There are some shortcomings existing in the prior art.

1. The angle of the spiral pipe with respect to the base is adjusted for the hit article to be at various angles and hit positions. The spiral pipe has a good fixing effect. However, the spiral pipe has to be adjusted to its original position for continuous hitting when the beginner hits the socket to result in inclination and displacement. This may lower the pleasure in practice.

2. When storing the conventional training device, the spiral pipe and the base have to be separated, and then the spiral pipe is rolled up as shown in FIG. 12. They are large in size. It is not convenient for carrying and storing the conventional training device.

SUMMARY OF THE INVENTION

According to the present invention, there is provided a training device for hitting a ball. The training device comprises a spiral pipe and a base. The spiral pipe is composed of a plurality of dual-awl ring members connected together to form an adjustable pipe. The spiral pipe comprises a top pipe at an upper end thereof to connect with a socket. The socket has a free end to form a recess. The spiral pipe comprises a bottom pipe and a positioning sleeve at a lower end thereof. The bottom pipe is provided with a first stop ring at a distal end thereof. The distal end of the bottom pipe has inner threads to engage with outer threads formed on an upper section of the positioning sleeve. The positioning sleeve is provided with a second stop ring at a lower section of the positioning sleeve. The base is in the shape of a home plate. The base has a through hole at a central portion thereof and a stepped trough underneath the through hole. The base comprises at least two plates. The two plates have relative connecting surfaces which are formed with notches and protrusions to engage with each other. Thereby, the protrusions are engaged with the notches for assembling the two plates to become one-piece. The bottom pipe is inserted in the through hole with the first stop ring to be blocked on the through hole.

The positioning sleeve is inserted in the stepped trough with the outer threads to engage with the inner threads of the bottom pipe. The second stop ring is secured in the stepped trough. The first stop ring and the second stop ring are secured in the middle of the base such that the spiral pipe is mounted on the base. The socket is fitted on the top pipe to complete the assembly of the present invention.

Preferably, the spiral pipe includes at least one pair of an upper threaded section and a lower threaded section to engage with each other.

Preferably, the base comprises a front plate and a middle plate. The front plate has a connecting surface which is formed with notches or protrusions to engage with protrusions or notches formed on a connecting surface of the middle plate.

Alternatively, the base comprises a front plate, a middle plate and a rear plate. The front plate and the rear plate each have a connecting surface which is formed with notches or protrusions to engage with protrusions or notches formed on a connecting surface of the middle plate.

When in use, the user can adjust the bending angle and the height of the spiral pipe relative to the base as desired, so that the hit article can be at different angles and hit positions for the user to simulate the hit position of various balls relative to the home plate. After hitting the hit article A, the spiral pipe has a restoring force to return the spiral pipe, providing a full-directional practice.

BRIEF DESCRIPTION OF THE DRAWINGS

FIG. 1-A is an exploded and cross-sectional view according to the first embodiment of the present invention;

FIG. 3 is a schematic view according to the first embodiment of the present invention to show that the spiral pipe is bent when in use;

FIG. 3-A is a front view of FIG. 3 according to the first embodiment of the present invention;

FIG. 4-A is a perspective view showing the bottom of the base according to the first embodiment of the present invention;

FIG. 4-B is a perspective view showing the top of the base according to the first embodiment of the present invention;

FIGS. 5A to 7A are front views of FIGS. 5 to 7 according to the first embodiment of the present invention;

FIG. 8 is an exploded view according to a second embodiment of the present invention;

FIG. 8-A is a perspective view according to the second embodiment of the present invention;

FIG. 9-A is a perspective view showing the bottom of the base according to the second embodiment of the present invention;

FIG. 9-B is a perspective view showing the top of the base according to the second embodiment of the present invention;

FIG. 10 is a perspective view of a conventional training device for hitting a ball;

FIG. 10-A is a front view of the conventional training device;

FIG. 11 is a perspective view of the conventional training device to show the spiral pipe is bent;

FIG. 11-A is a front view of the conventional training device to show the spiral pipe is bent.

DETAILED DESCRIPTION OF THE PREFERRED EMBODIMENTS

Embodiments of the present invention will now be described, by way of example only, with reference to the accompanying drawings.

Figure 4:
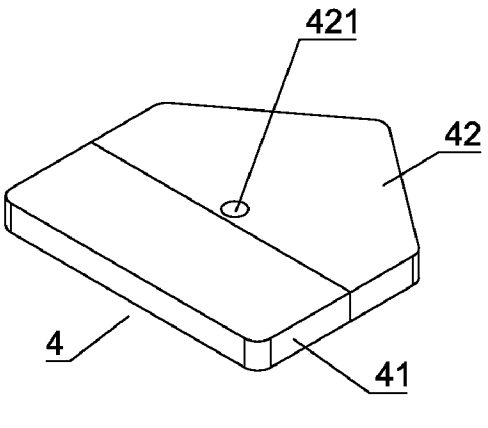
FIG. 4 is an exploded view of the base according to the first embodiment of the present invention.
Figure 4:
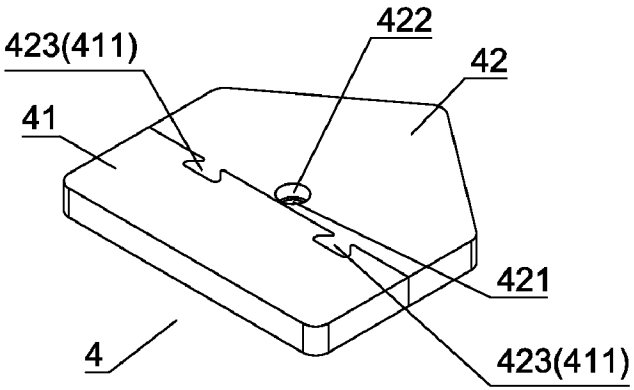
Figure 4:
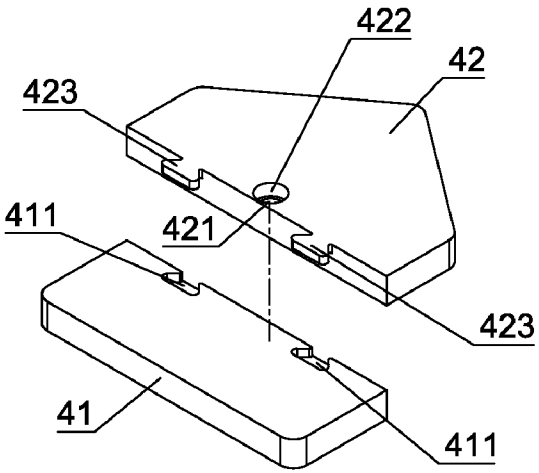
Figure 7:
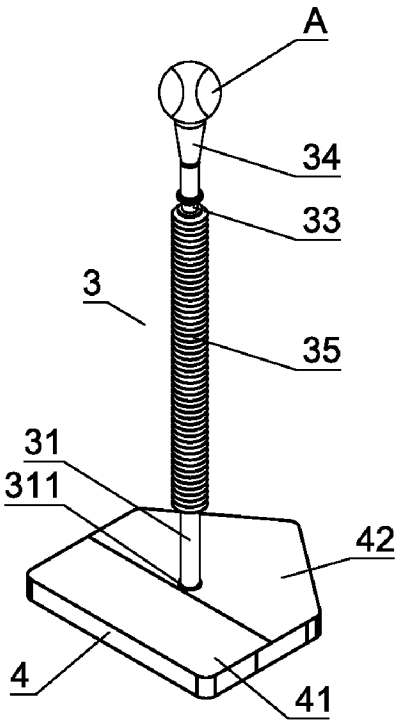
FIGS. 5 to 7 are schematic views according to the first embodiment of the present invention to show that the spiral pipe is extended in different lengths.
Figure 6:
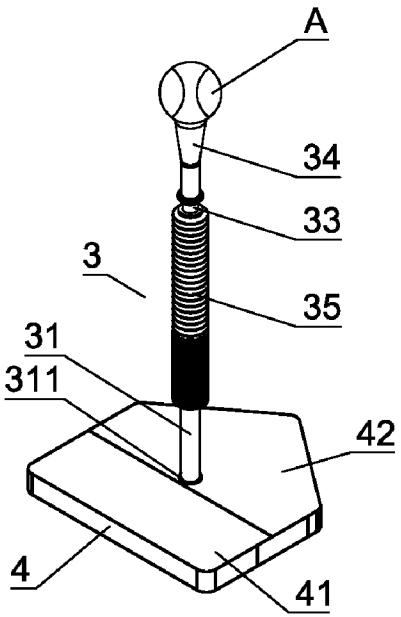
Figure 5:
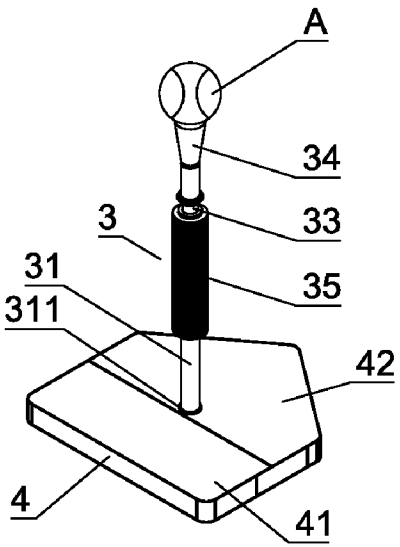

As shown in FIGS. 1 to 4, FIG. 1-A, FIG. 3-A, FIG. 4-A and FIG. 4-B, the present invention comprises a spiral pipe 3 and a base 4.

The spiral pipe 3 is composed of a plurality of dual-awl ring members 35 connected together to form an adjustable pipe. By pulling and compressing the plurality of dual-awl ring rings 35, the spiral pipe 3 is adjustable. The spiral pipe 3 has a restoring force to return after hitting. The spiral pipe 3 comprises a top pipe 33 at an upper end thereof to connect with a socket 34. The socket 34 can be integrally formed with the spiral pipe 3. The socket 34 has a free end to form a recess 341 for holding a hit article A. The spiral pipe 3 further comprises a bottom pipe 31 and a positioning sleeve 32 at a lower end thereof to connect with a through hole 421 and a stepped trough 422 of the base 4. The bottom pipe 31 is provided with a first stop ring 311 at a distal end thereof for being blocked on the through hole 421. The distal end of the bottom pipe 31 has inner threads to engage with outer threads 322 formed on an upper section of the positioning sleeve 32. The positioning sleeve 32 is provided with a second stop ring 321 at a lower section of the positioning sleeve 32 for being secured in the stepped trough 422. The first stop ring 311 and second stop ring 321 are secured in the middle of the base 4, so that the spiral pipe 3 is mounted on the base 4.

The base 4 is in the shape of a home plate, and has the through hole 421 at a central portion thereof and the stepped trough 422 underneath the through hole 421 to couple with the bottom pipe 31 and the positioning sleeve 32 of the spiral pipe 3. The base 4 is composed of a front plate 41 and a middle plate 42. The front plate 41 has a connecting surface which is formed with notches 411 or protrusions to engage with protrusions 423 or notches of the middle plate 42 so as to become one-piece. Accordingly, the present invention is assembled simply and quickly and is a handy device.

Figure 1:
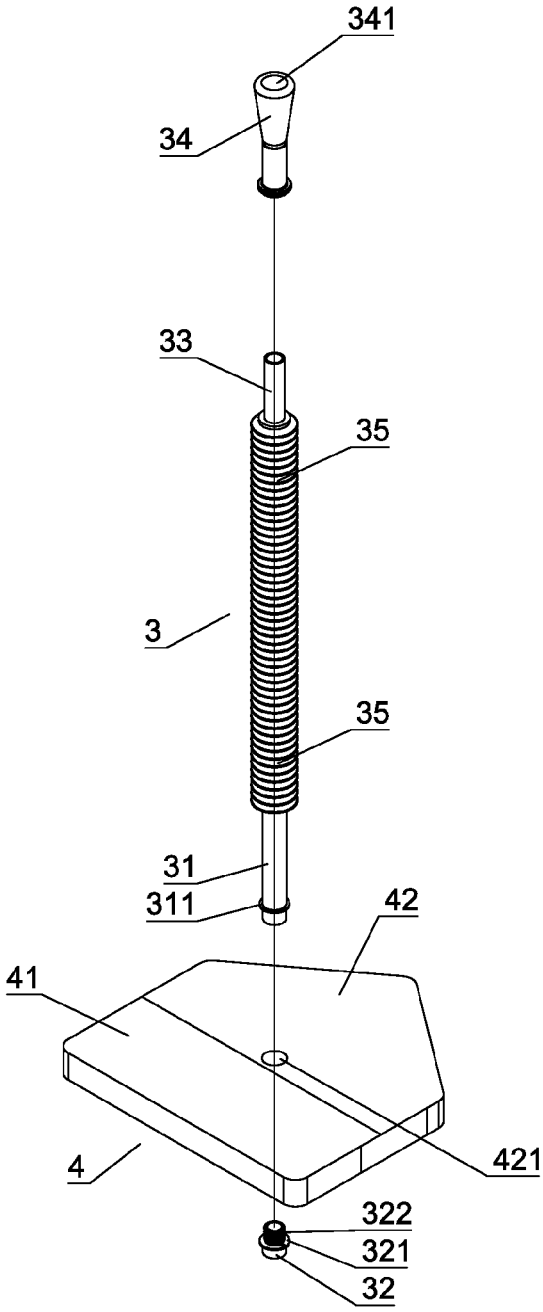
FIG. 1 is an exploded view according to a first embodiment of the present invention.
Figure 2:
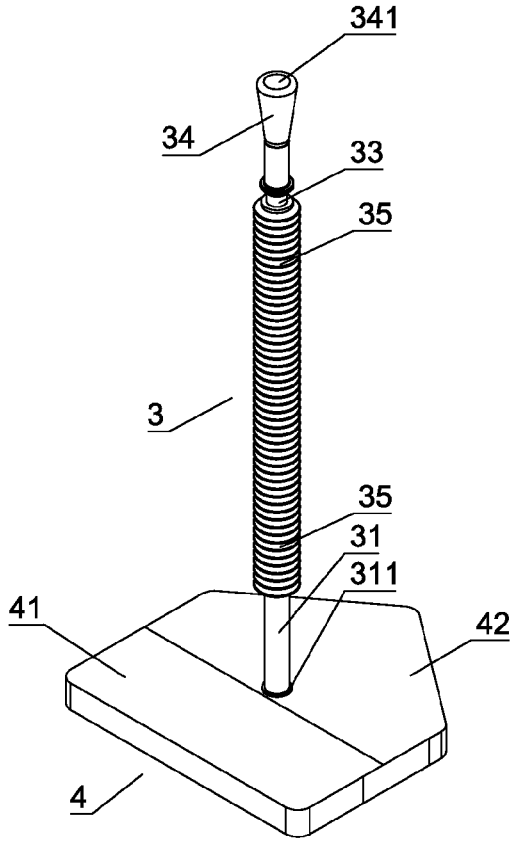
FIG. 2 is a perspective view according to the first embodiment of the present invention.

FIG. 1, FIG. 2, FIG. 1-A, FIG. 4, FIG. 4-A and FIG. 4-B show a first embodiment of the present invention. The protrusions 423 of the middle plate 42 are engaged with the notches 411 of the front plate 41, such that the two plates become one-piece. The bottom pipe 31 is inserted in the through hole 421 with the first stop ring 311 to be blocked on the through hole 421. The positioning sleeve 32 is inserted in the stepped trough 422 with the outer threads 322 to engage with the inner threads of the bottom pipe 31. The second stop ring 321 is secured in the stepped trough 422. The first stop ring 311 and second stop ring 321 are secured in the middle of the base 4, so that the spiral pipe 3 is mounted on the base 4. The socket 34 is fitted on the top pipe 33, so the training device of the present invention is completely assembled. The aforesaid procedures can be operated in reverse to disassemble the present invention, so that the socket 34, the spiral pipe 3, the front plate 41 and the middle plate 42 are separated for carrying and bagging. The present invention is simple to assemble, quick to disassemble, and convenient to carry.

Referring to FIG. 3, FIG. 3-A, FIGS. 5 to 7, FIGS. 5A to 7A, when in use, the user can adjust the bending angle and the height of the spiral pipe 3 relative to the base 4 as desired, so that the hit article A can be at different angles and hit positions for the user to simulate the hit position of various balls relative to the home plate. After hitting the hit article A, the spiral pipe 3 has a restoring force to return the spiral pipe 3, preventing the spiral pipe 3 form displacement.

Figure 9:
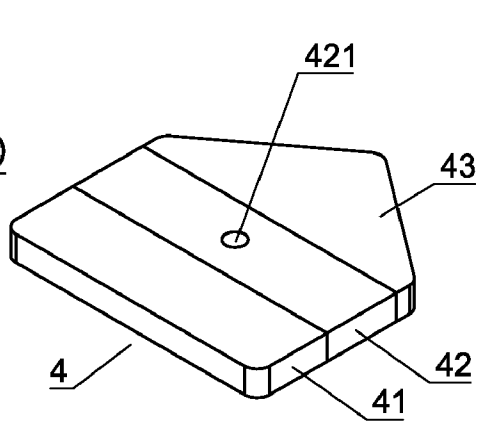
FIG. 9 is an exploded view of the base according to the second embodiment of the present invention.
Figure 9:
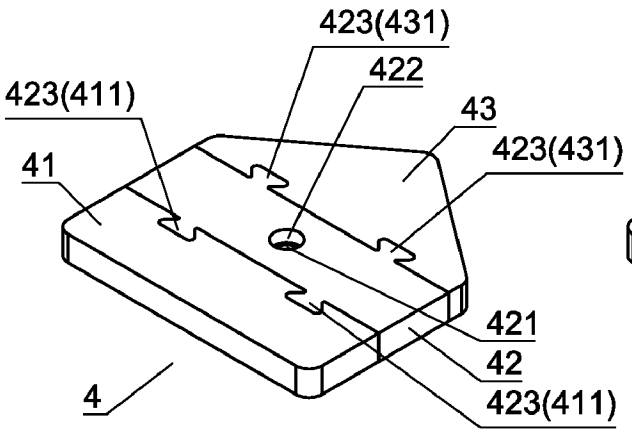
Figure 9:
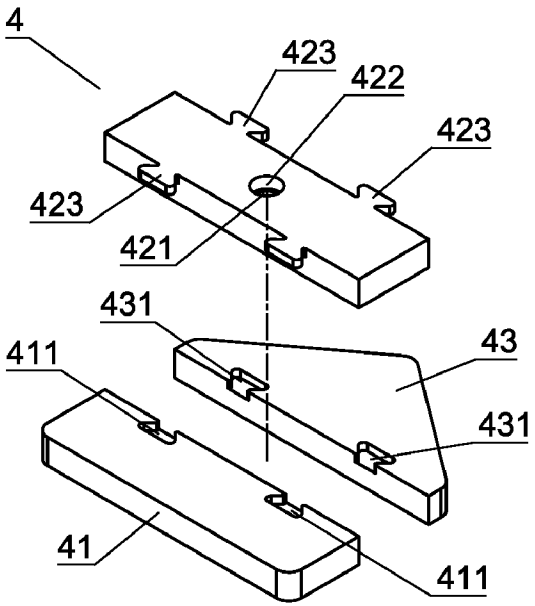
Figure 12:
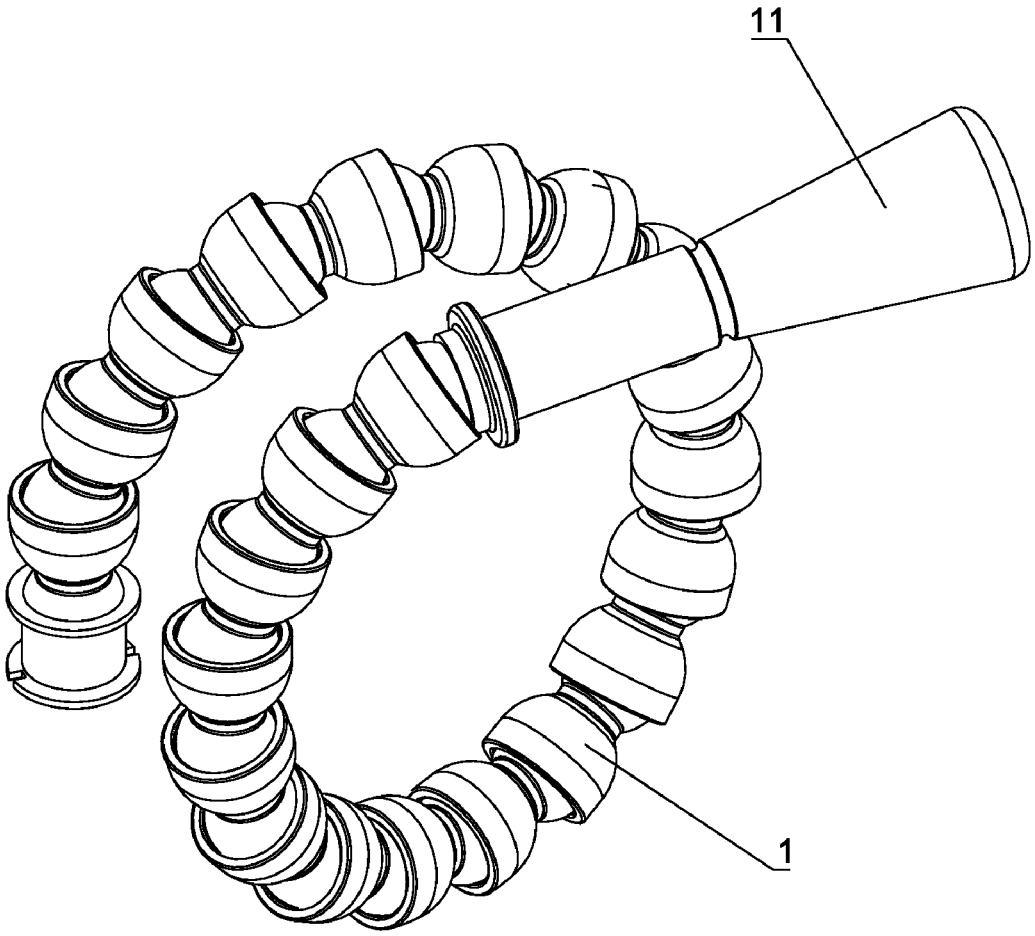
FIG. 12 is a perspective view to show the conventional spiral pipe is rolled up.

FIG. 8, FIG. 9, FIG. 8-A, FIG. 9-A and FIG. 9-B show a second embodiment of the present invention. The adjustable spiral pipe 3 composed of the plurality of dual-awl ring members 35 includes at least one pair of an upper threaded section 37 and a lower threaded section 36 for a screwed connection or disconnection. The base 4 is composed of a front plate 41, a middle plate 42 and a rear plate 43. Each of the front plate 41 and the rear plate 43 has a connecting surface which is formed with notches 411, 431 or protrusions to engage with protrusions 423 or notches of the middle plate 42 so as to become one-piece. The protrusions 423 of the middle plate 42 are engaged with the notches 411, 431 of the front plate 41 and the rear plate 43, such that the three plates become one-piece. The bottom pipe 31 is inserted in the through hole 421 with the first stop ring 311 to be blocked on the through hole 421. The positioning sleeve 32 is inserted in the stepped trough 422 with the outer threads 322 to engage with the inner threads of the bottom pipe 31. The second stop ring 321 is secured in the stepped trough 422. The first stop ring 311 and second stop ring 321 are secured in the middle of the base 4, so that the spiral pipe 3 is mounted on the base 4. The upper threaded section 37 and the lower threaded section 36 are screwed together to form the spiral pipe 3. The spiral pipe 3 is mounted on the base 4. The socket 34 is fitted on the top pipe 33, so the training device of the present invention is completely assembled. The aforesaid procedures can be operated in reverse to disassemble the present invention, so that the socket 34, the spiral pipe 3, the front plate 41, the middle plate 42 and the rear plate 43 are separated for carrying and bagging. The present invention is simple to assemble, quick to disassemble, and convenient to carry.

Accordingly, the training device of the present invention is assembled and disassembled quickly to decrease its volume for carrying conveniently and provides a resilient restoring function.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A training device for hitting a ball, comprising:

a spiral pipe composed of a plurality of dual-awl ring members connected together to form an adjustable pipe, the spiral pipe comprising:

a top pipe at an upper end thereof configured to connect with a socket, the socket having a free end to form a recess, and a bottom pipe with a positioning sleeve at a lower end thereof with a first stop ring at a distal end thereof, the distal end of the bottom pipe having inner threads to engage with outer threads formed on an upper section of the positioning sleeve, the positioning sleeve provided with a second stop ring at a lower section of the positioning sleeve; and a base in the shape of a home plate, the base comprising:

a middle plate with a through hole extending therethrough and a stepped trough underneath the through hole, and a front plate, the middle and front plates having relative connecting surfaces which are formed with notches and protrusions to engage with each other such that the protrusions are engaged with the notches for assembling the middle and front plates to become one-piece, the bottom pipe inserted in the through hole with the first stop ring to be blocked on the through hole, the positioning sleeve inserted in the stepped trough with the outer threads to engage with the inner threads of the bottom pipe, the second stop ring secured in the stepped trough, the first stop ring and the second stop ring secured in the middle of the base such that the spiral pipe is mounted on the base, the socket fitted on the top pipe.

2. The training device for hitting a ball as claimed in claim 1, wherein the socket is integrally formed with the spiral pipe.

3. The training device for hitting a ball as claimed in claim 1, the front plate having a connecting surface which is formed with notches or protrusions to engage with protrusions or notches formed on a connecting surface of the middle plate.

4. A training device for hitting a ball, comprising:

a spiral pipe composed of a plurality of dual-awl ring members connected together to form an adjustable pipe having at least one pair of an upper threaded section and a lower threaded section, the spiral pipe comprising a top pipe at an upper end thereof to connect with a socket, the socket having a free end to form a recess, the spiral pipe comprising a bottom pipe and a positioning sleeve at a lower end thereof, the bottom pipe provided with a first stop ring at a distal end thereof, the distal end of the bottom pipe having inner threads to engage with outer threads formed on an upper section of the positioning sleeve, the positioning sleeve provided with a second stop ring at a lower section of the positioning sleeve; and a base in the shape of a home plate, the base having a middle plate with a through hole and a stepped trough underneath the through hole and a front plate, the middle and front plates having relative connecting surfaces which are formed with notches and protrusions to engage with each other; thereby, the protrusions engaged with the notches for assembling the middle and front plates to become one-piece, the upper threaded section engaged with the lower threaded section, the bottom pipe inserted in the through hole with the first stop ring to be blocked on the through hole, the positioning sleeve inserted in the stepped trough with the outer threads to engage with the inner threads of the bottom pipe, the second stop ring secured in the stepped trough, the first stop ring and the second stop ring secured in the middle of the base such that the spiral pipe is mounted on the base, the socket fitted on the top pipe.

5. The training device for hitting a ball as claimed in claim 4, wherein the socket is integrally formed with the spiral pipe.

6. The training device for hitting a ball as claimed in claim 4, wherein the base further comprises a rear plate, the front plate and the rear plate each having a connecting surface which is formed with notches or protrusions to engage with protrusions or notches formed on a connecting surface of the middle plate.

* * * * *